US005992968A

United States Patent [19]

Uetsuki et al.

[11] Patent Number: 5,992,968

[45] **Date of Patent: *Nov. 30, 1999**

[54] INK JET PRINTING METHOD AND APPARATUS

[75] Inventors: Masaya Uetsuki; Hiromitsu Hirabayashi, both of Yokohama; Shigeyasu Nagoshi, Kawasaki; Noribumi Koitabashi; Hitoshi Sugimoto, both of Yokohama; Miyuki Fujita, Tokyo; Fumihiro Gotoh, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/490,084

[22] Filed: Jun. 13, 1995

[30] Foreign Application Priority Data

Jun. 15, 1994 [JP] Japan ..... 6-133009

[51] Int. Cl.[6] ..... B41J 23/00; B41J 2/14

[52] U.S. Cl. ..... 347/37; 347/47

[58] Field of Search ..... 347/20, 37, 40, 347/47, 39

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,359,355 | 10/1994 | Nagoshi et al. | 347/9 |
| 5,461,406 | 10/1995 | Lorenze, Jr. et al. | 347/65 |

FOREIGN PATENT DOCUMENTS

| | | | |
|---|---|---|---|
| 54-40637 | 3/1979 | Japan | 347/20 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |

*Primary Examiner*—John Barlow
*Assistant Examiner*—Craig A. Hallacher
*Attorney, Agent, or Firm*—Fitzpatrick, Cella, Harper & Scinto

[57] ABSTRACT

There are provided ink jet printing method and apparatus which assure that reciprocable printing can be realized at a high speed without any deterioration of a quality of printing. When an image is printed on a printing medium by using a multi-orifice head of which the ink ejecting direction relative to an opening surface is inclined in the return scanning direction, a scanning speed of the return scanning direction is delayed from the scanning speed in the reverse forward direction, an offset distance between a main dot and a satellite at the time of the return scanning is suppressed to be small, and in the case that printing is performed by reciprocable scanning, the satellite is received in the main dot not only during the forward scanning but also during the return scanning.

12 Claims, 11 Drawing Sheets

INK JET PRINTING METHOD AND APPARATUS

BACKGROUND OF THE INVENTION

1. Field of the Invention

The present invention relates to ink jet printing method and apparatus which assure that reciprocable printing is performed for a printing paper or a similar printing medium by reciprocably scanning an ink jet head.

DESCRIPTION OF RELATED ART

A printer operable in according with a thermal transferring printing system, a laser beam printing system, a dot impact printing system or an ink jet printing system has been heretofore used as a terminal unit for a personal computer or an object unit for a copying machine, facsimile or the like.

Among the aforementioned types, attention has been paid to the ink jet printing system because the latter exhibits excellent quietness. Especially, since the ink jet type adapted to eject ink by utilizing a phenomenon of foaming while heating has many advantageous features that printing can be effected at a high density, each printing operation can easily be achieved by using colored inks, it has excellent quietness, it can stand against printing at a high speed, attention has been paid to it as a printing method which has a high quality and can be produced at a reduced cost.

As each printing operation is increasingly performed at a high speed in recent years, an ink jet head having a plurality of ejecting ports arranged thereon, i.e., a multi-head is generalized, and moreover, an ink jet head including plural multi-heads has been developed to cope with the tendency that printing is performed using plural colored inks.

FIG. 8 shows by way of example the structure of a printer section for printing a printing paper using a multi-head of the foregoing type.

In FIG. 8, reference numeral 101 denotes four cartridges in total. Each cartridge 101 is constructed of an ink tank filled with one of four colored inks (black, cyan, magenta and yellow) and a multi-head 102 assigned to each ink tank. A plurality of ink ejection holes are formed on each multi-head 102 by a quantity of n in the arrow-marked Y direction, and moreover, the number n of ink ejection holes formed on each of the four multi-heads 102 are arranged in parallel with each other while they are offset in the arrow-marked X direction. The ink ejection holes on the four multi-heads 102 may be formed while they are arranged in parallel with each other with some inclination, e.g., in the arrow-marked X direction in FIG. 8. In this case, printing is effected by ejecting ink from each nozzle with certain time lag. In FIG. 8, reference numeral 103 denotes a paper feeding roller. While a printing paper (printing medium) 107 is held between the paper feeding roller 103 and an auxiliary roller 104, the paper feeding roller 103 is rotated in the arrow-marked direction to feed the printing paper 107 in the arrow-marked Y direction (conveyance direction). Reference numeral 105 denotes an opposing pair of paper feeding rollers. As the paper feeding rollers 107 are rotated in the arrow-marked direction, paper feeding operation is performed while the printing paper 107 is clamped between the pair of paper feeding rollers 105. Reference numeral 106 denotes a carriage for supporting the four cartridges 101 thereon. While a printing operation is performed, the carriage 106 is reciprocably displaced in the arrow-marked X direction. When no printing operation is performed or each multi-head 102 is subject to recovering treatment, the carriage 105 is displaced to a home position h represented by phantom lines in FIG. 8 to assume a standby state.

Before a printing operation is started, the carriage 106 is located at the home position h represented by phantom lines.

As the carriage 106 is displaced in the arrow-marked X direction (scanning direction) on receipt of a printing operation starting command, ink is selectively ejected from ink ejection ports 221 of each multi-head 102, whereby one line having a width corresponding to the number n of ink ejection ports 221 is printed on the surface of the printing paper 107. In such manner, when data corresponding to one line are printed to the scanning end of the printing paper 107, the carriage 106 is displaced in the opposite direction to the X direction to return to the original home position h. Thereafter, the carriage 106 is displaced in the X direction again to perform printing corresponding to next one line. It should be noted that in the case that reciprocable printing is achieved, the carriage 106 performs a printing operation also when the carriage 106 is displaced in the opposite direction to the X direction. In each case, the paper feeding roller 103 is rotated in the arrow-marked direction before printing corresponding to next one line is started after printing corresponding to one line is completed, whereby the printing paper 107 is fed in the Y direction by a distance corresponding to the printed width of one line. By repeating printing corresponding to one line and paper feeding in the above-described manner, data are printed on one surface of the printing paper 107.

The case that the multi-head 102 is scanned in the arrow-marked $X_1$ direction in FIG. 8 to start a printing operation from the home position h side is hereinafter referred to as forward scanning, and the case that the multi-head 102 is scanned in the arrow-marked $X_2$ direction in FIG. 8 to perform a printing operation toward the home position h is hereinafter referred to as return scanning.

Thus, in the case that printing is achieved merely by forward scanning by using such an apparatus as mentioned above, the return scanning becomes a completely useless scanning, and this is one factor for obstructing high speed printing. In view of the foregoing fact, a trial is made for performing a reciprocable printing operation by using the return scanning for attaining high speed printing. In the case that printing is effected by the ink jet printing apparatus, a small ink droplet separated from a main ink droplet forming a main dot is shot onto the paper surface to form a small dot in addition to the main dot shot onto the paper surface with an ink droplet ejected from the ink ejection port. This small dot is called "a satellite". A small droplet forming this satellite is originally ejected at the same time as a main droplet, and it appears in the form of a tail on the rear side of the main droplet by the action of a tensile force arising between the main droplet and the liquid surface of a meniscus in the ink ejecting hole. The tail portion is separated from the main droplet so that it is liable to be transformed into a spherical contour by the action of the surface tension. Therefore, it is considered that the small droplet forming a satellite assumes more rearward function than the main droplet attributable to the surface tension arising when it is separated from the meniscus in the ink ejecting hole. Thus, the small droplet has a low ejection speed than the main droplet.

In the case that the surface of the printing paper 107 is parallel with the opening surface having the ink ejecting hole formed thereon, the positional relationship between the main droplet having a different ejection speed and the small droplet forming a satellite is kept constant as long as the opening surface is uniform, and a quality of reciprocable printing hardly varies with the exception that remarkable temperature elevation arises.

However, in the case that each ink ejecting hole is formed in the inclined state relative to the opening surface, there locally arises a difference in ink affinity to the opening surface, whereby the direction of ejection of the small droplet forming the satellite varies. A proposal has been made with respect to a method of controlling the position of a satellite by utilizing the aforementioned nature (see Japanese Patent Application Laid-Open No. 43510/1993). In the case that one side printing is concerned, it is possible that a small droplet having a lower speed than that of the main droplet and having deviation of the ejection direction (i.e., small droplet forming the satellite) is received in the main dot on the printing surface. In addition, things are same in the case that the opening surface is formed of a different material as viewed in the scanning direction. Namely, by using a material having higher affinity to ink as a structural member at the position located on the opposite side to the scanning direction, it is possible to control the ejecting direction of the small droplet forming a satellite in the same manner as the case that the opening surface is inclined as mentioned above.

The structure of a multi-head 102 having each ink ejecting hole 221 inclined relative to the opening surface is shown, e.g., in FIG. 9 to FIG. 11 or FIG. 12.

The former multi-head 102 (see FIG. 9 to FIG. 11) consists of a ceiling plate 21, a heater board 23 and a orifice plate 25 which are connected to each other as shown in the drawings. A shown in FIG. 11, an ink feeding port 211, an ink storage (common chamber) 212 and a plurality of ink flow paths 213 are formed on the ceiling plate 21. A plurality of heaters (electrothermal transducers) located in the ink flow paths 213 and wiring 232 for separately feeding electricity to each heater 231 to heat the same are formed on the heater board 23. In addition, ink ejecting holes 221 corresponding to the ink flow passages 213 are formed through the orifice plate 25. Reference numeral 222 denotes an opening surface for the ink ejection holes 221.

The method of simply and easily producing the multi-head 102 is exemplified by a method of forming ink ejecting holes 221 after integrally molding the ceiling plate 21 and the orifice plate 25. In the case of such production method, since it is difficult to form the ejecting holes 221 at a right angle relative to the opening surface 222, the ejecting holes 221 are formed from upper direction of the ceiling plate 21 as viewed in FIG. 11. Provided that the ejecting holes 221 are formed in that way, it is unavoidable that the ejecting holes 221 are slightly inclined relative to the opening surface 222.

With the multi-head 102 as shown in FIG. 9 to FIG. 11, the ink supplied in the ink storage 212 is supplied to the ink flow paths 213 due to appearance of a capillary phenomenon so that ink is stably held by forming a meniscus in each of the ejecting holes 221. By feeding electricity to the heater 231 via the wirings 232, ink in each heater 231 is heated and a foaming phenomenon arises due to film boiling in ink so that an ink droplet is ejected from each ink ejecting hole 221 by the action of the foaming energy.

On the other hand, with the multi-head 102 shown in FIG. 12, an opening surface 222 is inclined in the forward scanning direction (arrow-marked $X_1$ direction), and consequently, the ink ejecting holes 221 are slantwise opened relative to the opening surface 222.

In such manner, although the ink ejecting holes 221 are slantwise opened relative to the opening surface 222 in the forward direction (arrow-marked direction $X_1$ direction) or in the return direction (arrow-marked direction $X_2$), in the case that printing is effected in one direction printing, a quality of printing can be maintained with few formations of satellites by controlling the direction of ejection of small droplets each forming a satellite.

In the case that printing is effected by reciprocable scanning, a quality of image can be obtained with few formations of satellites by controlling the direction of ejection of small dots each forming a satellite in one direction scanning, but there arises a problem that many satellites are formed in the other reverse direction scanning, resulting in a quantity of image being degraded, because the direction of ejection of small droplets each forming a satellite is reversed.

OBJECT OF THE INVENTION

An object of the present invention is to provide an ink jet printing method and apparatus which assure that in the case printing is effected by reciprocable scanning, reciprocable printing can be realized at a high speed without any reduction of a printing quality by receiving each satellite in a main dot not only in forward scanning but also in return scanning.

SUMMARY OF THE INVENTION

According to a first aspect of the present invention, there is provided an ink jet printing method wherein when reciprocable printing is performed for a printing medium by reciprocably scanning an ink jet head by using the ink jet head including a plurality of ink ejecting ports for ejecting ink therefrom and an opening surface having the ink ejecting ports formed therethrough, the ink ejecting direction relative to the opening surface is inclined to either of the forward scanning direction and the return scanning direction of the ink jet head, wherein when the ink jet head is scanned in the direction of inclination of the ink ejected from the ink ejecting ports, a speed of scanning the scanning head is delayed from the time when the ink jet head is scanned in the reverse direction to the foregoing one.

In addition, according to a second aspect of the present invention, there is provided an ink jet printing apparatus wherein when reciprocable printing is performed for a printing medium by reciprocably scanning an ink jet head by using the ink jet head including a plurality of ink ejecting ports for ejecting ink therefrom and an opening surface having the ink ejecting ports formed therethrough, the ink ejecting direction relative to the opening surface is inclined to either of the forward scanning direction and the return scanning direction of the ink jet head, wherein the apparatus further includes a scanning speed controlling section for delaying a speed of scanning the ink jet head from the time when the ink jet head is scanned in the reverse direction to below-noted one, when the ink jet head is scanned in the direction of inclination of the ink ejected from the ink ejecting ports.

In other words, according to the present invention, since the apparatus includes the structure for changing the reciprocable scanning corresponding to the inclination of the ink ejecting direction relative to the opening surface having a plurality of ink ejecting ports formed therethrough, e.g., in the case that a monochromatic image is printed, a density difference during the reciprocable printing can be suppressed to be small by reducing the increasing of the area factor attributable to the satellite, and an extent of ruggedness of a vertical line can be reduced, resulting in a quality of image being improved.

In the case a color image is printed, the variation of the area factor attributable to the satellite can be reduced, and a high quality of image having few fluctuation in color can be obtained by performing reciprocable printing.

Excessive elevation of the ink jet head which was a problem for a conventional reciprocable printing system can simultaneously be suppressed, color fluctuation and density difference caused by the increasing of a temperature of the ink jet head can be reduced, and moreover, reduction of the working temperature of the ink jet head assures that durability of the ink jet head can be elongated much more than the conventional ink jet head.

The above and other objects, effects, features and advantages of the present invention will become more apparent from the following description of embodiments thereof taken in conjunction with the accompanying drawings.

DESCRIPTION OF THE PREFERRED EMBODIMENT

The present invention will now be described in detail hereinafter with reference to the accompanying drawings which illustrate preferred embodiments thereof.

First Embodiment

Figure 8:
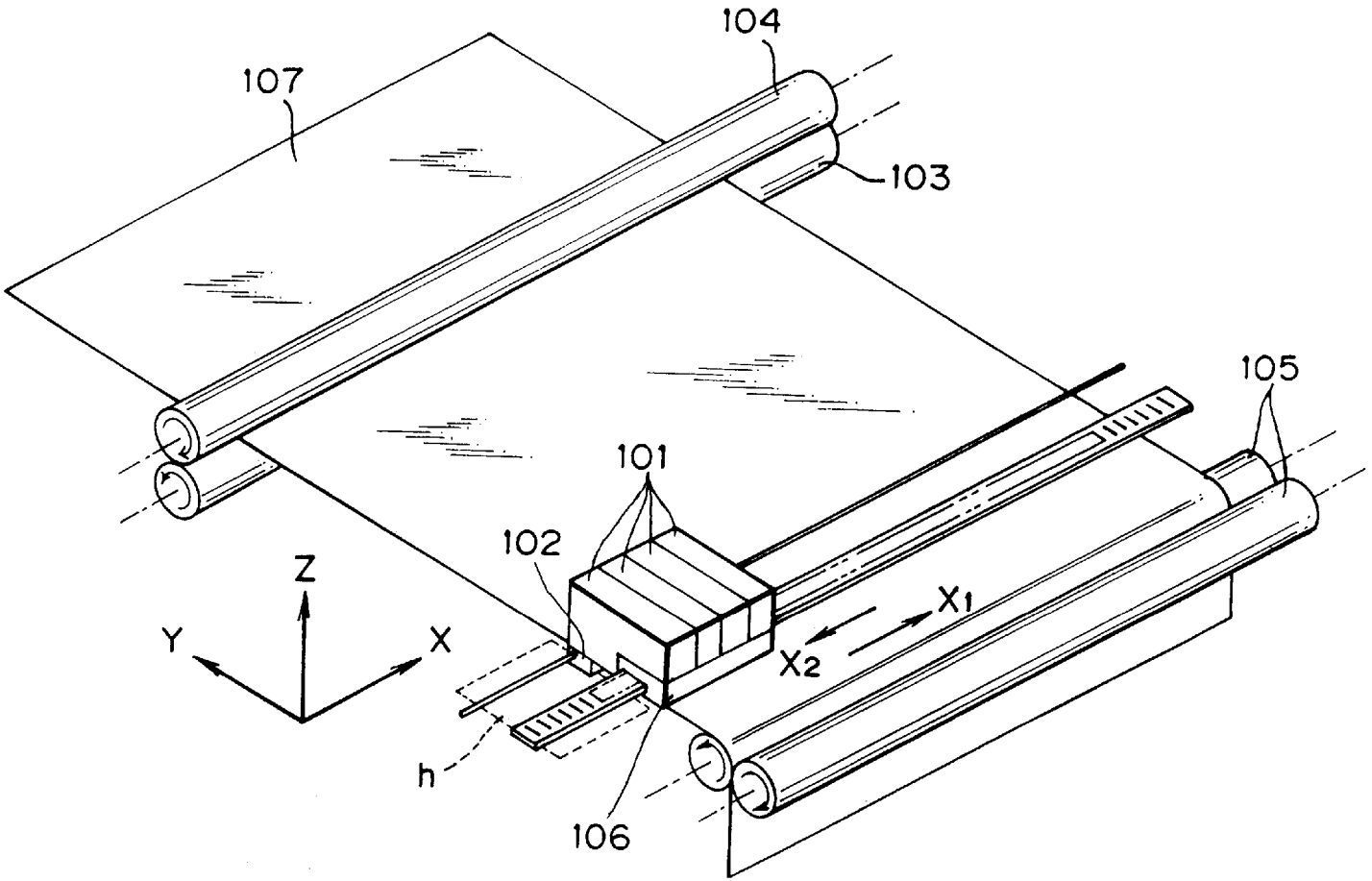
FIG. 8 is a perspective view of a printer for an ink jet printing apparatus of the present invention.
Figure 9:
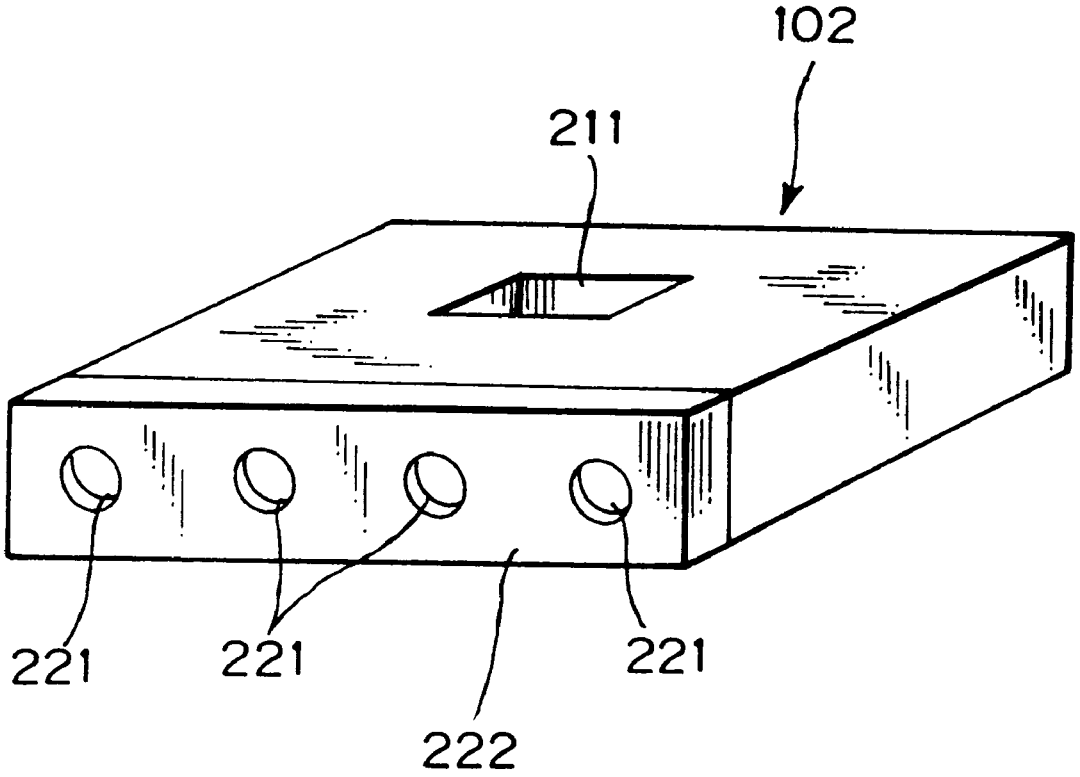
FIG. 9 is a perspective view which shows by way of example the structure of an ink jet head.
Figure 10:
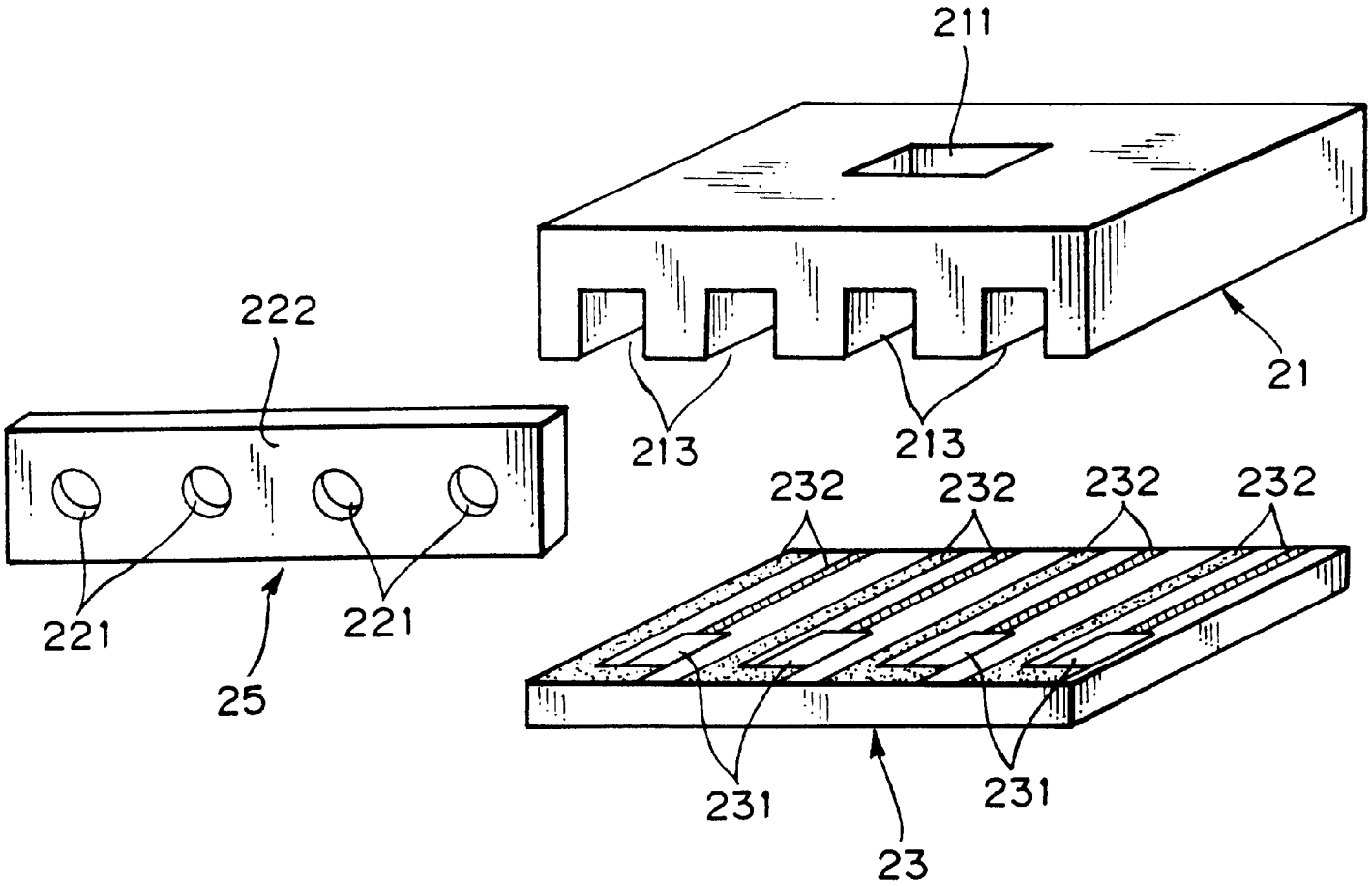
FIG. 10 is a perspective view which shows the ink jet head shown in FIG. 9 in the disassembled state.
Figure 11:
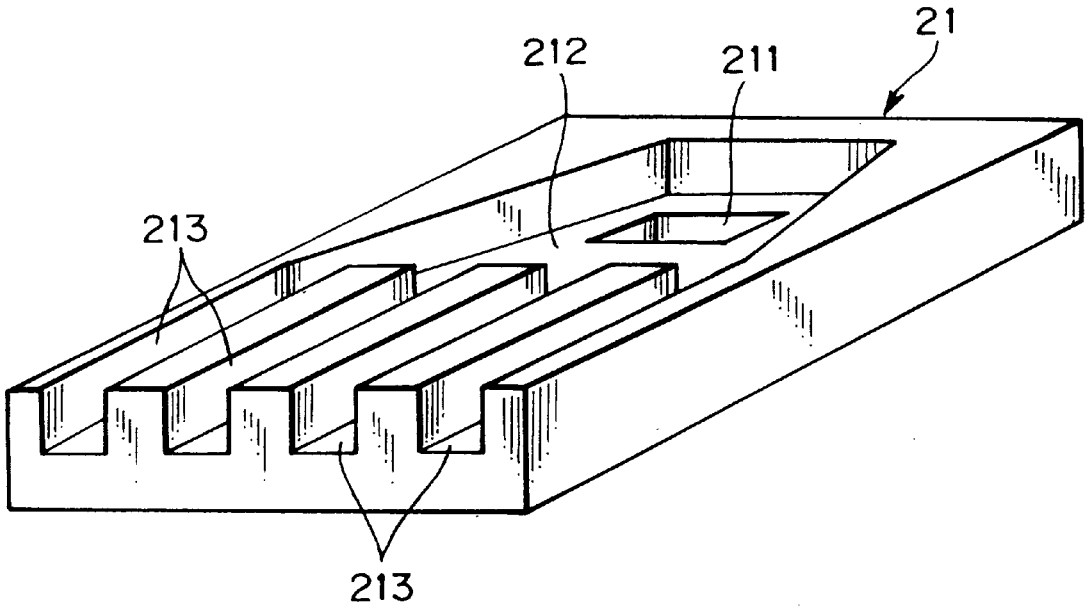
FIG. 11 is a perspective view of a ceiling plate shown in FIG. 10 as viewed from the rear surface side.
Figure 12:
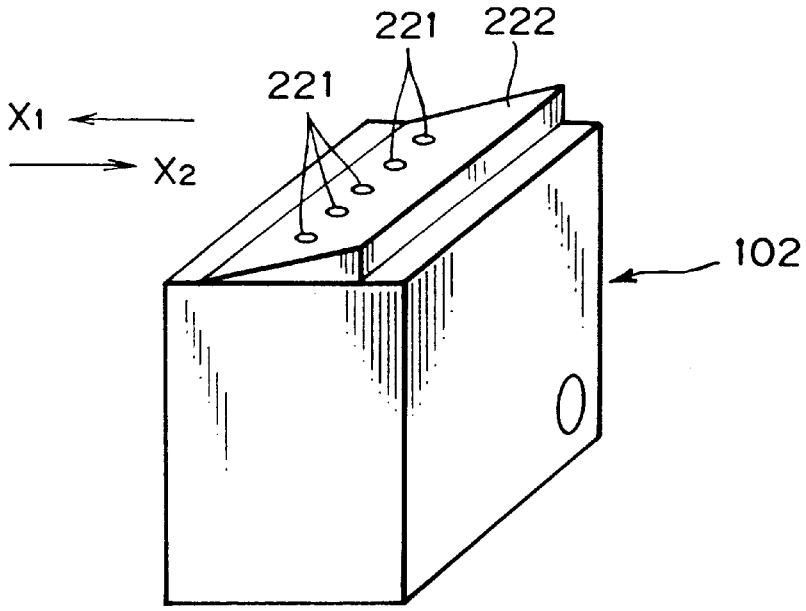
FIG. 12 is a perspective view which shows by way of other example the structure of an ink jet head.

In this embodiment, monochromatic printing was effected using black ink by reciprocably scanning a multi-head 102. An ink jet head employed for this embodiment was such that it included a printer section having the same structure as mentioned above with reference to FIG. 8 and each ink ejecting hole was inclined in the forward scanning direction relative to the opening surface to which the ink ejecting hole is opened. The multi-head 102 is exemplified by a multi-head as mentioned above with reference to FIG. 9 to FIG. 11 wherein a ceiling plate 21 is integrated with an orifice plate 25 and each ink ejecting hole 221 is opened in the inclined state in the forward scanning direction, and a multi-head as mentioned above with reference to FIG. 12 wherein an opening surface 222 is inclined. In addition, a multi-head wherein a part of the opening portion having a plurality of ink ejecting ports formed therethrough in the scanning direction thereof is formed from a different material may be substituted for the aforementioned multi-head.

Figure 1:
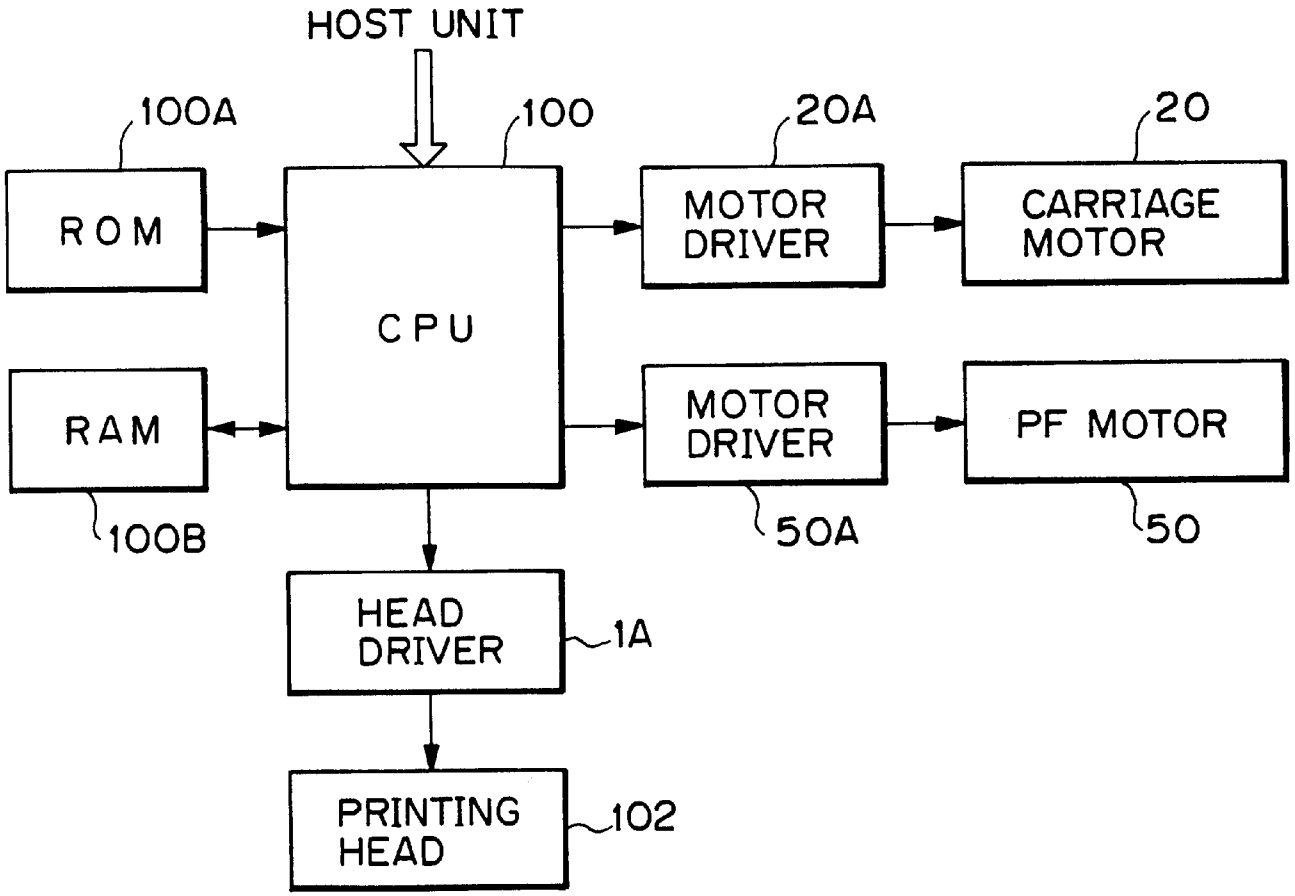
FIG. 1 is a block diagram which shows the structure of a controlling system for an ink jet printing apparatus constructed in accordance with a first embodiment of the present invention.

Referring to FIG. 1 which shows a block diagram for a controlling system of an ink jet apparatus constructed in accordance with this embodiment, CPU 100 executes control processing, data processing or the like for operating of each part of the apparatus. ROM 100A has a procedure for these processings stored therein. In addition, RAM 100B is used as a work area for executing the aforementioned processings.

Ink ejection from the multi-head 102 is effected by feeding driving data for a heater 231 and a driving/controlling signal to a head driver 1A. Further, CPU 100 controls the rotation of a carriage motor 20 for displacing a carriage 106 (see FIG. 8) and the rotation of a paper feeding motor 50 for rotating conveyance rollers 103, 104 and 105, via motor drivers 20A and 50A. Additionally, as will be described later, CPU 100 constitutes a scanning speed controlling section for controlling the rotational speed of the carriage motor 20 in order to change a scanning speed corresponding to the scanning direction of the multi-head 102.

In this embodiment, monochromatic printing is effected by changing the scanning speed of forward scanning and return scanning, and a distance between gravity centers of a main dot and a satellite as shown in Experiment Example 1, 2 and 3 of the following table was measured. In these experiment examples, a scanning speed for forward scanning was delayed from a scanning speed for return scanning, and the experiment examples were compared with Comparative Examples 1 and 2 each having a same scanning speed. It should be noted that the driving frequency of the multi-head 102, i.e., an ejection frequency of ink droplets to be ejected from the multi-head 101 was changed corresponding to the scanning speed, and in this embodiment, the scanning speed when the driving frequency of the multi-head 102 having 360 dpi (dot/inch) was set to 6 kHz corresponded to 42.3 cm/s and scanning speeds when the driving frequency was set to 5 kHz, 4 kHz, 3 kHz and 2 kHz correspond to 35.3 cm/s, 28.2 cm, 21.2 cm/s and 14.1 cm/s.

TABLE 1

Results derived from experiments of monochromatic printing

| | scanning speed (cm/s) | | L (μm) | | | |
|---|---|---|---|---|---|---|
| | forward scanning | return scanning | forward scanning | return scanning | Δ OD25 (Black) | Tmax (° C.) |
| Comparative Example 1 | 42.3 | 42.3 | 60.5 | 98.0 | 0.15 | 72 |
| Experiment Example 1 | 42.3 | 35.3 | 61.4 | 83.2 | 0.09 | 65 |
| Experiment Example 2 | 42.3 | 28.2 | 60.8 | 65.8 | 0.03 | 43 |

TABLE 1-continued

| Results derived from experiments of monochromatic printing | | | | | | |
|---|---|---|---|---|---|---|
| | scanning speed (cm/s) | | L (μm) | | | |
| | forward scanning | return scanning | forward scanning | return scanning | Δ OD25 (Black) | Tmax (° C.) |
| Comparative Example 2 | 21.2 | 21.2 | 49.5 | 70.1 | 0.13 | 46 |
| Experiment Example 3 | 21.2 | 14.1 | 51.0 | 54.8 | 0.01 | 39 |

In the above table, Tmax represents a highest reached temperature (° C.) of the multi-head and $_{\Delta}$OD25 represents a result obtained by measuring a difference in black density between forward scanning and return scanning after completion of printing under condition of 25% duty.

As is apparent from Table 1, in contrast with the comparative examples each having same forward and return scanning speeds, in the experiment examples having a return scanning speed delayed from a forward scanning speed, the difference in distance between a main dot and a satellite at the time of forward and that between a main dot and a satellite at the time of return scanning was reduced. Thus, as will be described later, an extent of ruggedness of a vertical line due to the presence of a satellite was reduced, and moreover, it became possible to print characters, and vertical lines of the like with a high quality. In addition, density variation due to the increasing of an area factor attributable to formation of the satellite was improved. Further, as auxiliary effects, excessive elevation of the temperature of the multi-head 102 was suppressed, and moreover, fluctuation of density due to the reduction of ink viscosity and deterioration of exactness of dot shooting can be prevented.

Figure 2A:
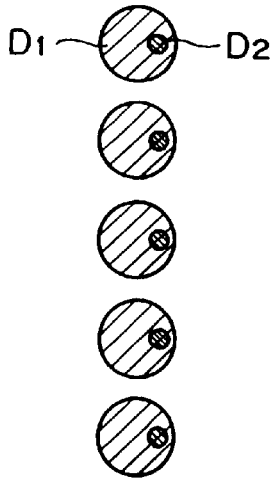
FIG. 2A and FIG. 2B are diagrammatical views which show the positional relationship between main dots and satellites formed at the time of forward scanning in Experiment Example 1 conducted in accordance with the first embodiment of the present invention, respectively.
Figure 2B:
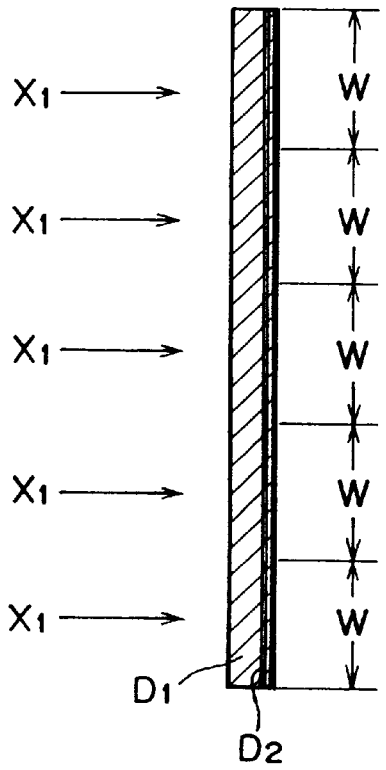
Figure 3A:
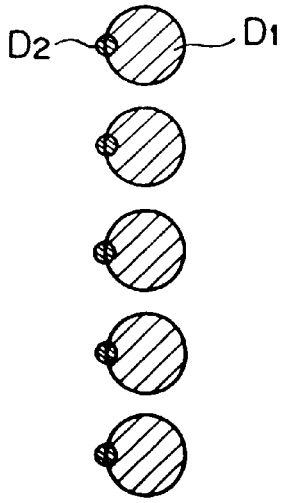
FIG. 3A and FIG. 3B are diagrammatical views which show the positional relationship between main dots and satellites formed at the time of return scanning in Experiment Example 1 conducted in accordance with the first embodiment of the present invention, respectively.
Figure 3B:
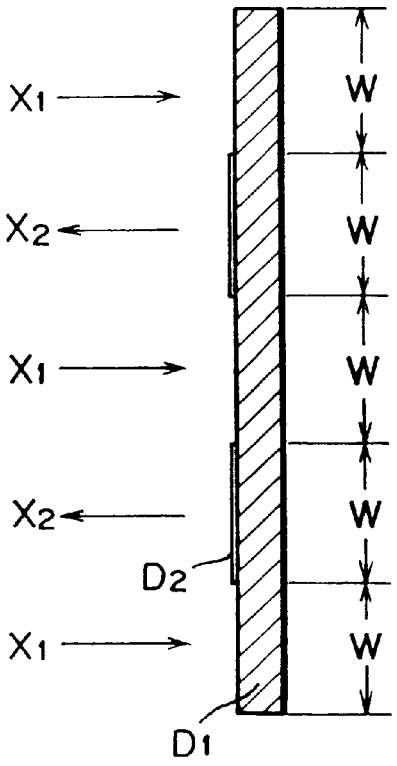

In the Experiment Example 1, the positional relationship between a main dot $D_1$ and satellite $D_2$ formed during forward scanning is shown in FIG. 2A, the positional relationship between them formed during return scanning is shown in FIG. 3A, and vertical lines formed by repeated forward and return scannings are shown in FIG. 3B. In FIG. 3B, reference character W denotes a printed width of one line. A vertical line having a length (5×W), i.e., five times of the width W was formed by three forward scannings and two return scannings. FIG. 2B shows by way of example a printed vertical line in the case that only forward scannings are repeated by five times in this experiment example.

Figure 4A:
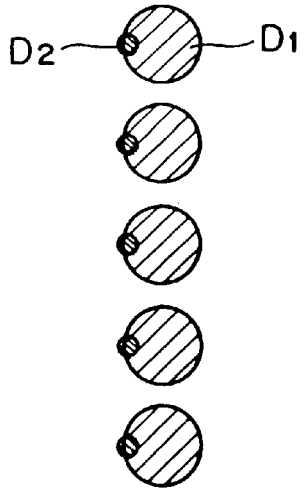
FIG. 4A and FIG. 4B are diagrammatical views which show the positional relationship between main dots and satellites formed at the time of return scanning in Experiment Example 2 conducted in accordance with the first embodiment of the present invention, respectively.
Figure 4B:
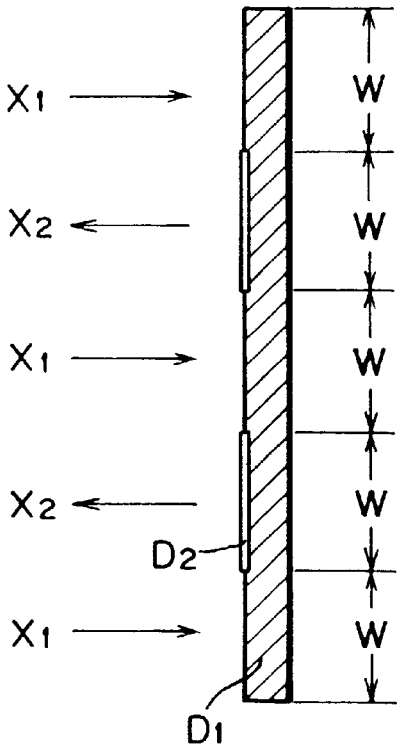

FIG. 4A shows the positional relationship between a main dot $D_1$ and a satellite $D_2$ formed at the time of forward scanning in Experiment Example 2, and FIG. 4B shows a vertical line formed by forward and return scannings in the Experiment Example 2.

Figure 5A:
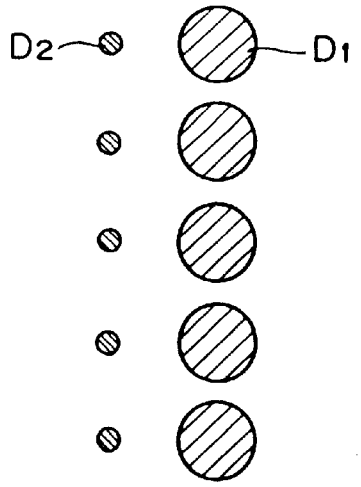
FIG. 5A and FIG. 5B are diagrammatical views which show the positional relationship between main dots and satellites formed at the time of return scanning in Comparative Example 1 conducted in accordance with the first embodiment of the present invention, respectively.
Figure 5B:
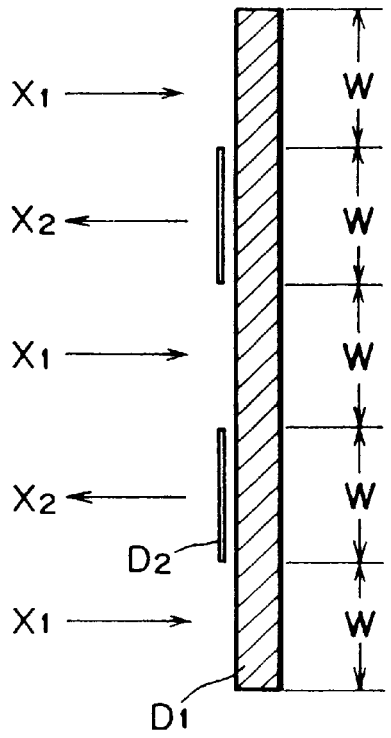

FIG. 5A shows the positional relationship between a main dot $D_1$ and satellite $D_2$ formed at the time of forward scanning in the Comparative Example 1, and FIG. 5B shows a vertical line printed by forward and return scannings in the Comparative Example.

As is apparent from FIG. 2 to FIG. 5, an extent of ruggedness of printed vertical line was reduced, and moreover, a quality of image is improved by delaying a scanning speed at the time of return scanning (at the time when scanning is effected in the direction of inclination toward the ink ejecting direction) from a scanning speed at the time of return scanning.

Figure 6A:
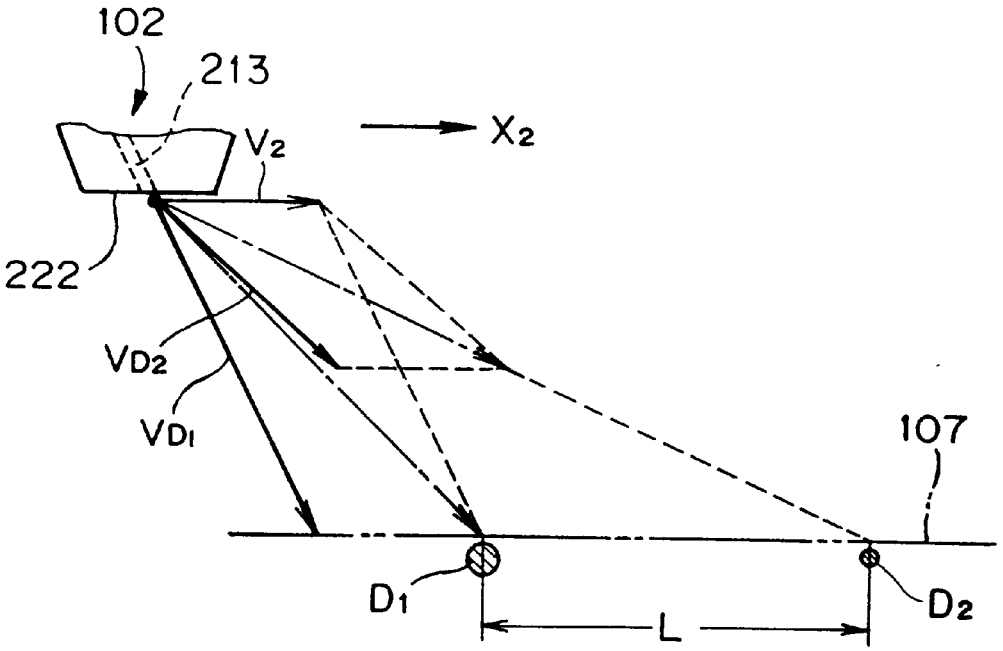
FIG. 6A and FIG. 6B are diagrammatical views which show the relationship between scanning speeds of an ink jet head and positions having dots formed in accordance with the first embodiment of the present invention, respectively.
Figure 6B:
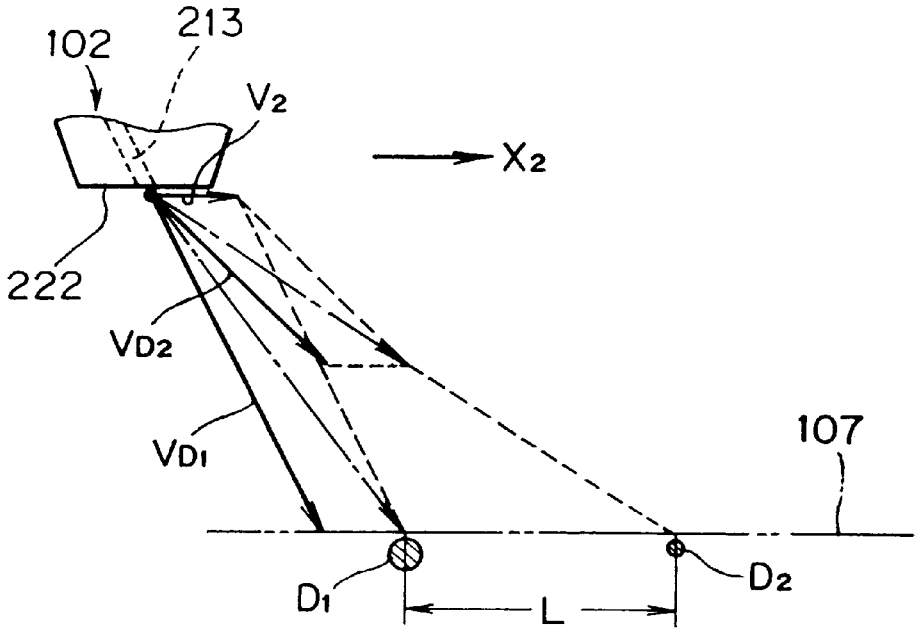

FIG. 6A and FIG. 6B show the positional relationship between a main dot $D_1$ and a satellite $D_2$ at the time of return scanning in the arrow-marked $X_2$ direction, and in FIG. 6A, the scanning speed $V_2$ is set to be comparatively large, and in FIG. 6B, the scanning speed $V_2$ is set to comparatively small. In these drawings, $V_{D1}$ represents an ejection speed of a main droplet forming a main dot $D_1$, and $V_{D2}$ represents an ejection speed of a small droplet forming a satellite $D_2$. The small droplet has an ejection speed $V_{D2}$ which is smaller than the ejection speed $V_{D1}$ of the main droplet, and the ejection direction of the small droplet is deviated relative to the main droplet under the influence of an affinity of ink to an opening surface 222 of the multi-head 102. After all, in the case that the scanning speed V2 is large, a distance between the main dot $D_1$ and the satellite $D_2$ becomes large as shown in FIG. 6A, and in the case that the scanning speed $V_2$ is small, the distance L between them becomes small as shown in FIG. 6B.

Figure 7:
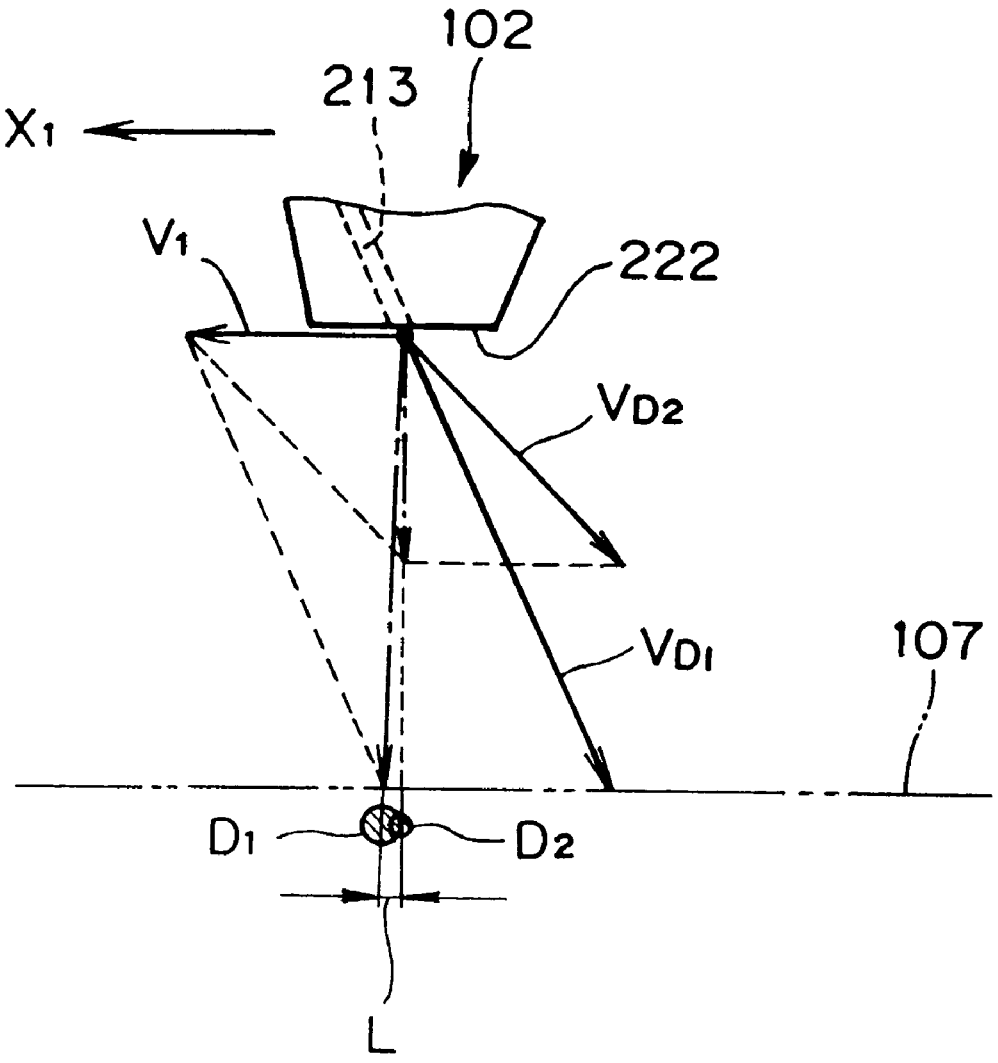
FIG. 7 is a diagrammatical view which shows the relationship between a forward scanning speed of the ink jet head and a position having a dot formed in accordance with the first embodiment of the present invention.

FIG. 7 shows the relationship between a main dot $D_1$ and a satellite $D_2$ at the time of forward scanning in the arrow-marked $X_1$ direction, and the influence of the distance due to variation of the main scanning speed $V_1$ is small compared with the time of forward scanning shown in FIG. 6.

Second Embodiment

In this embodiment, three multi-heads 102 each constructed in accordance with the first embodiment, i.e., multi-heads 102 each of which ink ejecting direction relative to the opening surface was inclined toward the return scanning direction were mounted on a carriage 106 (FIG. 8) so that cyan (C) ink droplets, magenta (M) ink droplets and yellow (Y) ink droplets were ejected from the multi-heads 102 to perform a multi-colored printing operation. Forward scanning speed and return scanning speed were changed as shown on Experiment Examples 4 and 5 of the following Table 2 to effect multi-colored printing, and a distance L between a main dot and a satellite was measured. In each of these experiment examples, the scanning speed at the time of return scanning was delayed from the scanning speed at the time of forward scanning, and the experiment examples 4 and 5 were compared with Comparative Example 3 having same forward and return scanning speed.

TABLE 2

| Results derived from experiments of multi-colored printing | | | | | | |
|---|---|---|---|---|---|---|
| | scanning speed (cm/s) | | L (μm) | | | |
| | forward scanning | return scanning | forward scanning | return scanning | ΔE | Tmax (° C.) |
| Comparative Example 3 | 42.3 | 42.3 | 61.2 | 98.3 | C 0.25 | 71 |
| | | | 62.0 | 99.0 | M 0.22 | |
| | | | 61.8 | 98.7 | Y 0.23 | |
| Experiment Example 4 | 42.3 | 35.3 | 61.8 | 83.4 | C 0.18 | 66 |
| | | | 61.5 | 82.8 | M 0.17 | |
| | | | 60.9 | 83.2 | Y 0.19 | |
| Experiment Example 5 | 42.3 | 28.2 | 61.3 | 67.5 | C 0.13 | 43 |
| | | | 61.8 | 67.7 | M 0.12 | |
| | | | 61.5 | 68.0 | Y 0.11 | |

In the above table, $_{\Delta}$E represents results obtained by measuring a difference in color density between forward scanning and return scanning after completion of printing under condition of 25% duty.

As is apparent from Table 2, in contrast with the comparative example having same forward and return scanning speeds, in the experiment examples each having a return scanning speed delayed from a forward scanning speed, a difference between a main dot and a satellite at the time of forward scanning and a difference between the same at the time of return scanning became small. Thus, as will be described later, an extent of ruggedness of a vertical line due to the presence of the satellite was reduced, and moreover, it became possible to print characters, vertical lines or the like with a high quality. In addition, color density variation due to the increasing of an area factor attributable to formation of the satellite was improved. Further, as auxiliary effects, excessive elevation of temperature of the multi-head 102 was suppressed, and moreover, fluctuation of density due to the reduction of viscosity and deterioration of exactness of dot shooting could be prevented.

The aforementioned embodiments have been described above with respect to an ink jet printing apparatus for which an electrothermal transducer for generating thermal energy was used as an energy generating element. However, the present invention can equally be applied to an ink jet printing apparatus having an electromechanical element such as a piezo element or the like used therefor.

With a typical structure and principle of an ink jet printing apparatus having an electrotransducer, laser light or the like used therefor, it is preferable to employ a fundamental principle disclosed in e.g., U.S. Pat. No. 4,723,129 and No. 4,740,796. Although this system can be applied to either of a so-called on-demand type and a continuous type, it is especially advantageously employable for operating in the form of the on-demand type printing apparatus. This is because the on-demand type printing apparatus includes electrothermal transducers each disposed corresponding to a printing medium or an ink path having ink retained therein and operates in the following manner. In response to at least one driving signal applied to the electrothermal transducers corresponding to a printing information to induce sudden temperature rise in excess of the appearance of a phenomenon of nucleate boiling in ink, thermal energy is generated in the electrothermal transducers, causing a phenomenon of film boiling to appear on the heating portion of an ink jet head. This leads to the result that gas bubbles are grown in ink in the one-to-one relationship relative to the driving signal. By using the growth and contraction of the gas bubbles, at least one ink droplet is formed by ejection from an ink ejecting port. The driving signal generated in the form of a pulse is preferably employable because the growth and contraction of the gas bubbles can instantaneously be achieved, resulting in ink being ejected with excellent responsiveness. As driving signals to be outputted in the form of pulses, those described in U.S. Pat. Nos. 4,463,359 and 4,345,262 are preferably employable. Incidentally, when conditions disclosed in an U.S. Pat. No. 4,313,124 on a temperature rising rate of the heating portion are employed, it is possible to perform a more excellent printing operation.

With respect to the structure of the ink jet head, reference is made to U.S. Pat. Nos. 4,558,333 and 4,459,600 both of which are incorporated in the present invention. According to these prior inventions, the structure including heating portions disposed on bent portions of the printing head in addition to a combination made among the ejecting ports, the ink paths (linearly extending ink flow paths and ink flow paths extending at a right angle relative to the preceding ones) and the electrothermal transducers is disclosed in the foregoing prior inventions. In addition, the present invention can advantageously be applied to the structure disclosed in Japanese Patent Application Laid-Open No. 123670/1984 so as to allow a common slit to be used as ejecting portions for a plurality of electrothermal transducers. Additionally, the present invention can likewise advantageously be applied to the structure disclosed in Japanese Patent Application Laid-Open No. 138462/1984 so as to allow opening holes for absorbing pressure waves caused by thermal energy to be used as ejecting portions. Thus, irrespective of the configuration of the ink jet head, the present invention assures that each printing operation can reliably be achieved at a high efficiency.

Further, the present invention can advantageously be applied to a serial type ink jet head fixedly secured to a main body of the printing apparatus or an exchangeable chip type ink jet head which is electrically connected to the main body of the printing apparatus or a cartridge type ink jet head having an ink tank made integral with the ink jet head itself.

In addition, with respect to the structure of the ink jet printing apparatus, it is preferable that the printing apparatus is equipped with ejection recovering means, preliminary assisting means or the like, because they serve to make the advantageous effects of the present invention more stable. Concretely, capping means effective for capping the ink jet head therewith, cleaning means, pressurizing means or sucking means, preliminary heating means including electrothermal transducers or a combination of electrothermal transducers with a separate element, and preliminary ejecting means adapted to eject ink separately of printing can be noted as ejecting and recovering means as well as preliminary assisting means.

The kind and the number of ink jet heads to be mounted on the ink jet printing apparatus can be also changed as desired. For example, only one recording head corresponding to a monochromatic ink is acceptable. In addition, a plurality of ink jet heads corresponding to plural kinds of inks different in color and density to be printed are also acceptable. In other words, the printing mode of the printing apparatus should not limited to a printing mode having a main color such as black color or the like. The printing apparatus of the present invention has at least one printing mode derived from plural colors or mixed colors regardless of how the ink jet head is constructed by a single unit or by plural segments.

In addition, in each of the aforementioned embodiments of the present invention, each ink to be used has been explained as liquid. Alternatively, ink which is kept solid at a temperature equal to or lower than a room temperature but softened or liquidized at the room temperature may be used. In the ink jet system, since the temperature of ink to be used is generally controllably adjusted within the temperature range of b 30° C. to 70° C. or less so as to allow the viscosity of the ink to be maintained within the stable ejecting range, ink which is liquidized when a printing signal is applied to the ink jet head may be used. In addition, to positively prevent the temperature of ink from being elevated due to the thermal energy applied to the recording head by utilizing the energy arising when the solid state is changed to the liquid state or to prevent the ink from being vaporized, ink which is kept solid in the unused state but liquidized on receipt of heat may be used. At any rate, the present invention can be applied to the case that in response to a printing signal, ink is liquidized on receipt of thermal energy and the liquid ink is then ejected from the ink jet head, the case that ink starts to be solidized when an ink droplet reaches a printing medium, and the case that ink has such a nature that it is liquidized only in response to application of thermal energy to the recording head. In such cases, while ink is retained in concavities or through holes formed in porous sheet material in the form of a liquid substance or a solid substance, the ink may face to the electrothermal transducers as described in Japanese Patent Application Laid-Open No. 56847/1979 or Japanese Patent Application Laid-Open No. 71260/1985. According to the present invention, a most advantageous result can be obtained by any one of the aforementioned kinds of inks when the film boiling system is executed.

Further, the ink jet printing apparatus of the present invention can be employed in a combined state not only as an image output terminal unit of an information processing unit such as a computer but also as a copying machine combined with an optical reader or a facsimile having a signal sending/receiving function.

The present invention has been described in detail with respect to preferred embodiments, and it will be now be that changes and modifications may be made without departing from the invention in its broader aspects, and it is the intention, therefore, in the appended claims to cover all such changes and modifications as fall within the true spirit of the invention.

What is claimed is:

1. An ink jet printing method wherein reciprocal printing is performed for a printing medium by reciprocally scanning an ink jet head including a plurality of ink ejecting ports for ejecting ink therefrom and an opening surface having said ink ejecting ports formed therethrough, the ink ejecting direction relative to said opening surface being inclined toward either of a forward scanning direction and a return scanning direction of said ink jet head, the method comprising the steps of:

scanning said ink jet head in a direction toward inclination of the ink ejecting direction at a first scanning speed to effect printing for the printing medium, said ink jet head driving at a first driving frequency during scanning at the first scanning speed; and scanning said ink jet head in a reverse direction at a second scanning speed which is lower than the first scanning speed to effect printing for the printing medium, said ink jet head driving at a second driving frequency, which is lower than the first driving frequency, during scanning at the second scanning speed.

2. An ink jet printing method as claimed in claim 1, further comprising the step of providing said ink jet head with said ink ejecting ports being slantwise opened relative to said opening surface.

3. An ink jet printing method as claimed in claim 1 or 2, further comprising the step of providing said ink jet head with said opening surface being formed of a material having different affinity to ink.

4. An ink jet printing method as claimed in claim 1 or 2, further comprising the step of providing said ink jet head with said opening surface being inclined toward either of the forward scanning direction and the return scanning direction.

5. An ink jet printing method as claimed in claim 1 or 2, further comprising the step of providing a plurality of additional ink jet heads, with each ink jet head ejecting different ink.

6. An ink jet printing method as claimed in claim 1 or 2, further comprising the step of providing said ink jet head with an electrothermal transducer for generating thermal energy to cause a phenomenon of film boiling in ink to eject the ink.

7. An ink jet printing apparatus wherein reciprocable printing is performed for a printing medium by reciprocally scanning an ink jet head including a plurality of ink ejecting ports for ejecting ink therefrom and an opening surface having said ink ejecting ports formed therethrough, an ink ejecting direction relative to said opening surface being inclined toward either of a forward scanning direction and a return scanning direction of said ink jet head, said apparatus comprising:

scanning means for scanning said ink jet head to reciprocally effect printing on the printing medium;

a scanning controlling section for controlling said scanning means, said scanning controlling section controlling so that said ink jet head is scanned at a first scanning speed when said ink jet head is scanned in the direction of inclination of the ink ejection, while said ink jet head is scanned at a second scanning speed slower than the first scanning speed when said ink jet head is scanned in the reverse direction; and driving means for driving said ink jet head at a first driving frequency during scanning at the first scanning speed, and driving said ink jet head at a second driving frequency, which is lower than the first driving frequency, during scanning at the second scanning speed.

8. An ink jet printing apparatus as claimed in claim 7, wherein said ejecting ports are slantwise opened relative to said opening surface.

9. An ink jet printing apparatus as claimed in claim 7 or 8, wherein said opening surface is formed of a material having different affinity to ink.

10. An ink jet printing apparatus as claimed in claim 7 or 8, wherein said opening surface is inclined toward either of the forward scanning direction and the return scanning direction.

11. An ink jet printing apparatus as claimed in claim 7 or 8, further comprising a plurality of additional ink jet heads, with each ink jet head ejecting different ink.

12. An ink jet printing apparatus as claimed in claim 7 or 8, wherein said ink jet head comprises an electrothermal transducer for generating thermal energy to cause a phenomenon of film boiling in ink to eject the ink.

* * * * *

UNITED STATES PATENT AND TRADEMARK OFFICE

CERTIFICATE OF CORRECTION

PATENT NO. : 5,992,968

DATED : November 30, 1999

INVENTOR(S) : UETSUKI ET AL.

It is certified that error appears in the above-identified patent and that said Letters Patent is hereby corrected as shown below:

COLUMN 1:
Line 12, "according" should read --accordance--.
Line 16, "object" should read --output--.
Line 24, "stand against" should read --withstand--.

COLUMN 2:
Line 34, "trial is" should read --test was--.

COLUMN 3:
Line 8, "same" should read --the same--.
Line 22, "A" should read --As--.

COLUMN 10:
Line 47, "b 30°C." should read --30°C.--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*